United States Patent [19]

Fabbri et al.

[11] Patent Number: 4,958,772

[45] Date of Patent: Sep. 25, 1990

[54] SPRINKLER LINE FOR LOCALIZED IRRIGATION

[75] Inventors: Augusto Fabbri, Quartiano di Mulazzano; Aldino Rivi, Ferrara, both of Italy

[73] Assignee: Enichem Agricoltura S.p.A., Palermo, Italy

[21] Appl. No.: 455,939

[22] Filed: Dec. 21, 1989

Related U.S. Application Data

[63] Continuation of Ser. No. 784,818, Oct. 4, 1985, abandoned.

[30] Foreign Application Priority Data

Oct. 15, 1984 [IT] Italy ..... 23151 A/84

[51] Int. Cl.[5] ..... B05B 15/00

[52] U.S. Cl. ..... 239/542

[58] Field of Search ..... 239/541, 547, 533.1, 239/533.13

[56] References Cited

U.S. PATENT DOCUMENTS

| | | | |
|---|---|---|---|
| 3,698,195 | 10/1972 | Chapin | 239/542 X |
| 3,896,999 | 7/1975 | Barraán | 239/542 X |
| 4,009,832 | 3/1977 | Tiedt | 239/542 |
| 4,047,995 | 9/1977 | Leal-Diaz | 239/542 X |
| 4,285,472 | 8/1981 | Okada et al. | 239/542 |
| 4,385,727 | 5/1983 | Spencer | 239/542 X |
| 4,548,360 | 10/1985 | Delmer et al. | 239/542 |

FOREIGN PATENT DOCUMENTS

| | | | |
|---|---|---|---|
| 234610 | 4/1974 | Fed. Rep. of Germany | 239/542 |
| 2909795 | 7/1979 | France | 239/542 |

*Primary Examiner*—Andres Kashnikow
*Assistant Examiner*—Kevin P. Weldon
*Attorney, Agent, or Firm*—Hedman, Gibson, Costigan & Hoare

[57] ABSTRACT

A disposable sprinkler line for localized irrigation comprising a hose having outlet holes at equal distances from each other, and inner flexible membranes attached to the inner wall of the hose capable of forming interstices with the inner wall in the presence of a water flow. The inner flexible membranes are provided with openings at regular intervals and staggered relative to the outlet holes in the hose for receiving the pressurized water.

5 Claims, 1 Drawing Sheet

SPRINKLER LINE FOR LOCALIZED IRRIGATION

REFERENCE TO RELATED APPLICATIONS

The present application is a continuation of U.S. patent application Ser. No. 06/784,818 filed Oct. 4, 1985, now abandoned.

BACKGROUND AND SUMMARY OF THE INVENTION

The present invention relates to a device for the localized irrigation of agricultural fields, such device comprising a disposable sprinkler line having an outer hose and an inner flexible membrane.

In agriculture, sprinkler pipes used for irrigation purposes are provided with liquid outlet openings distributed along the length of the pipe to provide a nearly uniform wetting of the field to be watered.

Among these, the disposable type is the type which is used for one season only, picked up, possibly together with the plants constituting the cultivation, and destroyed.

The pipes comprising the sprinkling lines are part of a more complete irrigation system, connected to trunk lines from which water is supplied.

The system used generally comprise small cross sectional, sometimes tortuous pipe, designed to create a high enough pressure drop, to cause the liquid to stream out of the pipe in a dropwise fashion (U.K. Pat. Nos. 1,286,538 and 1,484,588). Such devices have the drawbacks that the droppers may be obstructed or that there may be a wide variation in flow rate between individual droppers due to pressure changes, particularly when there are elevational differences.

Other devices used for dropwise irrigation comprise pipes provided in their interior with one or more elastic membranes (U.S. Pat. No. 4,009,832 and Italian Patent Application No. 23,763 A/79). These devices, also suffer from the above mentioned drawbacks, i.e., uneven watering, due to the imperfect sticking of the inner membrane to the inner wall of the pipe.

We have now found, that it is possible to produce a sprinkler line of the disposable type for localized irrigation, which provides even watering and at the same time avoids any dangers of obstructing liquid flow.

It is an object of the present invention to provide a disposable sprinkler line comprising a hose having outlet holes equidistant from each other along the length of the hose and containing, in its interior, flexible membranes sticking to the inner wall of the hose, welded to the inner wall along their whole periphery and capable of forming interstices with the wall in the presence of a water flow. Each outlet hole of the hose is situated inside the interstices formed between the inner wall of the hose and the membrane; the membranes in turn are provided with at least one cut, positioned in a staggered relationship to the outlet holes in the hose.

BRIEF DESCRIPTION OF THE DRAWINGS AND DETAILED DESCRIPTION OF THE INVENTION

The following is a detailed description together with the accompanying drawings of an illustrative embodiment of the invention. It is to be understood that the invention is capable of modification and variation apparent to those skilled in the art within the spirit and scope of the invention.

Figure 1:
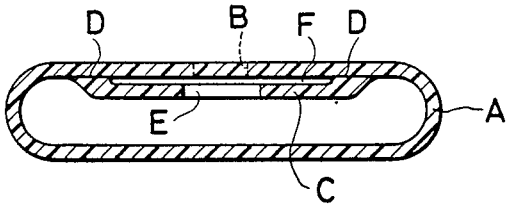
Figure 1A:
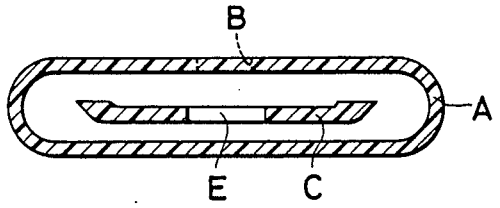
Figure 2:
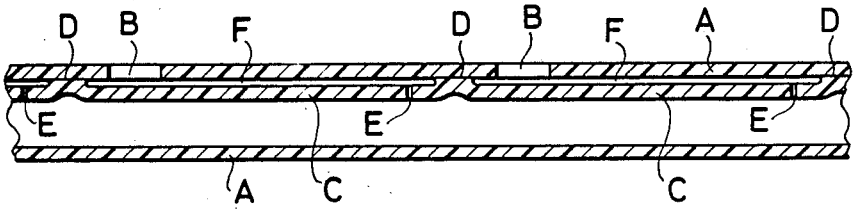

FIG. 1 is a transverse cross-sectional view of the sprinkler line according to the present invention;

FIG. 1*a* is a transverse cross-sectional view of the sprinkler line with the flexible membrane within the hose prior to welding to the inner wall; and FIG. 2 is a lengthwise cross-sectional view of the sprinkler line according to the present invention.

In each figure there is shown the wall of the hose (A), the inner membranes (C), the holes in the hose (B), the cuts in the membranes (E), the interstices (F), and the welds (D).

Referring to the figures, the sprinkler line comprises a hose A of flexible thermoplastic resin, which is provided with outlet holes B equidistantly placed along the length of the hose. Inside the hose flexible membranes C, made from thermoplastic material, are bonded to the hose by means of a weld D along the entire periphery of each membrane, so as to include in its interior at least one outlet hole. Each membrane is provided with a cut E, in a staggered position relative to the outlet hole, thereby effecting a communication between the interior of the hose with the interstice F which is formed between the membrane and the inner wall of the hose in the presence of a pressurized water flow.

A water passage is thus formed from the interior of the hose to the outer environment through the cut provided in the membrane, the interstice formed between the membrane and the hose, and the outlet hole provided in the hose.

The passage through the interstice is obstructed by the sticking of the membrane to the inner wall of the hose when water pressure is provided inside the hose. The obstructed interstices ensures that the water irrigation stream shall occur in a dropwise fashion.

It is also necessary that there be a certain pressure drop between the interior of the hose and the interstice, as precisely created by the cut in the membrane so as to ensure the sticking of the membrane to the inner wall of the hose, otherwise water gushes could occur along the first portion of the hose, which would prevent the hose from swelling and operating regularly.

The sticking of the membrane, in the vicinity of the cut and the outlet hole, is moreover favored by the bonding of the edges of the membrane very close to the cut on one side, and to the hole on the opposite side.

The cuts provided in the inner membranes preferably have dimensions equal to the diameters of the outlet holes provided in the hose in communication with the same interstice.

As hereinabove mentioned, the hose is comprised of a thermoplastic material selected from the group comprising olefinic polymers, vinyl polymers, polyamides, polyester resins, and so forth, or blends thereof. The hose can also be formed by co-extrusion of two or more of these materials. The membranes can be comprised of the same material as of the hose, or of a material compatible with it.

The above materials may be used as a pure material, or they may be suitably compounded with hydrophilic substances capable of modifying the contact angle between the water droplet and the polymer, thereby allowing variations of the water flow rate to be controlled. Examples of hydrophilic substances are nitrogen-containing compounds such as, amides, ammonium salt and ethylene oxide addition products.

The above-mentioned control can be further enhanced by the presence of additives comprising tackifiers selected from the group comprising derivatives of styrene, isoprene and ethylene copolymers.

The following Example illustrates the sprinkler line according to the present invention, but should not be construed as being limitative of the purposes thereof.

EXAMPLE

By using a high density polyethylene hose, having an inner diameter of 17 mm, a wall thickness of 0.1 mm, outlet holes of 4 mm in diameter, and an inner membrane of the same material and thickness, provided with cuts 5 mm long, spaced apart from the holes by 50 mm, a dropwise distribution was obtained with a flow rate of about 0.35 liters per hour per outlet hole.

We claim:

1. A disposable drip irrigation system for localized distribution of water, comprising:

a flexible hose for receiving pressurized water, said hose having a plurality of outlet apertures spaced equidistant from each other and extending along the length of said hose; a plurality of flexible membranes arranged within said hose to cover said outlet apertures, said membranes being attached along its entire periphery to the inner wall of said hose in generally spaced relation thereto so as to define a relatively narrow water passageway as compared to that defined by said flexible hose;

at least one slot approximately equal in length to the diameter of the outlet aperture in each of said membranes oriented in staggered relationship to said outlet apertures and being of an area so as to provide a sufficient pressure drop across said membrane to effectuate a collapse and adherance of said membrane to the inner wall of said hose when pressurized water is fed to said hose, wherein the attachment of the membranes to the inner wall of the hose are in close proximity to the outlet aperture in the hose at one end and to the slot in the membrane at the other end.

2. A disposable drip irrigation system as in claim 1, wherein said hose and said membranes comprise thermoplastic compounds.

3. A disposable drip irrigation system as in claim 2, wherein said thermoplastic compound is high density polyethylene.

4. A disposable drip irrigation system as in claim 3, further comprising a hydrophilic substance compounded with said polyethylene.

5. A disposable drip irrigation system as in claim 2, wherein the hose and the inner membranes are 0.1 mm thick.

* * * * *